United States Patent [19]

Kuzuya et al.

[11] Patent Number: 4,595,303

[45] Date of Patent: Jun. 17, 1986

[54] PRINTING APPARATUS WITH TWO PRINT HEADS

[75] Inventors: Susumu Kuzuya; Mamoru Imaizumi, both of Nagoya, Japan

[73] Assignee: Brother Kogyo Kabushiki Kaisha, Aichi, Japan

[21] Appl. No.: 671,617

[22] Filed: Nov. 15, 1984

[30] Foreign Application Priority Data

Nov. 19, 1983 [JP] Japan ..... 58-218251

[51] Int. Cl.[4] ..... B41J 3/50

[52] U.S. Cl. ..... 400/82; 101/93.12; 400/149

[58] Field of Search ..... 400/82, 144.2, 124, 400/149; 101/93.04, 93.05, 93.11, 93.12; 178/30

[56] References Cited

U.S. PATENT DOCUMENTS

| | | | |
|---|---|---|---|
| 3,185,823 | 5/1965 | Ellersick et al. | 400/74 X |
| 4,204,779 | 5/1980 | Lee | 400/149 X |
| 4,389,126 | 6/1983 | Honma | 400/82 |
| 4,444,519 | 4/1984 | Howell | 400/82 |

FOREIGN PATENT DOCUMENTS

| | | | |
|---|---|---|---|
| 11721 | 6/1980 | European Pat. Off. | 400/82 |
| 22397 | 1/1981 | European Pat. Off. | 400/124 |
| 3104351 | 9/1982 | Fed. Rep. of Germany | 400/82 |
| 156725 | 12/1979 | Japan | 400/82 |

*Primary Examiner*—Paul T. Sewell

*Attorney, Agent, or Firm*—Parkhurst & Oliff

[57] ABSTRACT

A printing apparatus having a first and a second printing assembly supported on a carrier which reciprocates along a line of printing defined on a platen. The first printing assembly has type elements adapted to be abuttable on the platen for printing characters on a sheet of paper supported on the platen, along the line of printing. The second printing assembly is adapted to print the characters with a matrix of dots. The first and second printing assemblies are so disposed that their print points are spaced from each other along the surface of the platen. The apparatus comprises first and second control units for controlling the operations of the first and second printing assemblies, respectively, according to input printing data. The apparatus further comprises a selector device which selects one of the first and second control units according to information included in the input printing data, so that the character represented by the character data of the printing data is printed by the corresponding one of the first and second printing assemblies.

9 Claims, 7 Drawing Figures

BCD VALUE OF REMAINING FOUR BITS

BCD VALUE OF FIRST FOUR BITS

| | 2 | 3 | 4 | 5 | 6 | 7 | 8 | 9 | A | B | C | D | E | F |
|---|---|---|---|---|---|---|---|---|---|---|---|---|---|---|
| 0 | sp | 0 | @ | P | ‘ | p | ç | É | á | ⠿ | | | ∝ | ≡ |
| 1 | ! | 1 | A | Q | a | q | ü | Æ | í | ⠿ | | | β | ± |
| 2 | " | 2 | B | R | b | r | é | FE | ó | ⠿ | | | γ | ≥ |
| 3 | # | 3 | C | S | c | s | â | ô | ú | | | | π | ≤ |
| 4 | $ | 4 | D | T | d | t | ä | ö | ñ | | | | Σ | ∫ |
| 5 | % | 5 | E | U | e | u | à | ò | Ñ | | | | σ | ∫ |
| 6 | & | 6 | F | V | f | v | å | û | ª | | | | μ | ÷ |
| 7 | ’ | 7 | G | W | g | w | ç | ù | º | | | | τ | ≈ |
| 8 | ( | 8 | H | X | h | x | ê | ÿ | ¿ | | | | Φ | ° |
| 9 | ) | 9 | I | Y | i | y | ë | Ö | ⌐ | | | | Θ | • |
| A | * | : | J | Z | j | x | è | Ü | ¬ | | | | Ω | · |
| B | + | ; | K | [ | k | { | ï | ¢ | ½ | | | | δ | √ |
| C | , | < | L | \ | l | ¦ | î | £ | ¼ | | | | ∞ | η |
| D | – | = | M | ] | m | } | ì | ¥ | ¡ | | | | ∅ | ² |
| E | . | > | N | ^ | n | ~ | Ä | Pts | « | | | | ∈ | ▮ |
| F | / | ? | O | _ | o | DEL | Å | f | » | | | | ∩ | DEL |

PRINTING APPARATUS WITH TWO PRINT HEADS

BACKGROUND OF THE INVENTION

The present invention relates to a printing apparatus which is capable of two different modes of printing, i.e., printing by means of type elements, and dot-maxtrix printing with a matrix of dots.

Generally, a printing operation by means of type elements (hereinafter referred to as "type-printing") is advantageous in printing quality, but disadvantageous for its limited number of characters (letters, numerals, symbols, etc.) available and low printing speed. On the other hand, a dot-matrix printing operation has substantially no limitation in the number of characters to be printed, and is high in printing speed. However, the dot-matrix printing with these advantages suffers a comparatively low level of printing quality.

In view of such circumstances in the prior art, a printing apparatus has been proposed, which is equipped with two printing units or assemblies for performing both of type-printing and dot-matrix printing. In such a printing apparatus known in the art, however, the two printing assemblies are selectively moved, as required, into a printing position corresponding to a print line along the platen of the printer so that a printing operation is effected by the selected one of the two printing assemblies. Alternatively, the printing assembly at the printing station is changed from one to the other so that the printing is achieved by the selected printing assembly. Such printer arrangements require troublesome selective movements or changes of the two printing assemblies for one printing position.

SUMMARY OF THE INVENTION

It is therefore an object of the present invention to provide a printing apparatus which solves the above indicated disadvantages of the known apparatus, and which allows type-printing and dot-matrix printing either selectively or concurrently at different positions on a record medium, without troublesome selective movement of one of two printing assemblies to a current printing position, or change of the printing assemblies from one to the other, and such that the type-printing or dot-matrix printing mode is automatically selected.

According to the invention, there is provided a printing apparatus having a platen to support a sheet of paper and a carrier which reciprocates to print a succession of characters along a line of printing defined on the platen, according to input printing data, the printing apparatus comprising: paper feeding means for feeding the sheet of paper on the platen in a direction perpendicular to the line of printing; a first printing assembly supported on the carrier and having type elements adapted to be abuttable on the platen for printing characters on the sheet of paper along the line of printing, the first printing assembly having a first print point at which the characters are printed with the type elements; a second printing assembly supported on the carrier for printing characters on the sheet of paper with a matrix of dots, the second printing assembly having a second print point at which the characters are printed with the matrix of dots, the second print point being spaced from the first print point in a direction along the surface of the platen; first and second control means for controlling the printing operations of the first and second assemblies, respectively; selector means, responsive to the input printing data, for selectively activating the first or second control means so that the character represented by the input printing data is printed by the first or second printing assembly.

The first printing assembly may use a known print head, for example, in the form of a daisy-type print wheel or a print ball, which carries multiple type elements. The second printing assembly may use a suitable dot-matrix print head, such as a wire-dot head having plural print wires selectively pushed against an inked ribbon to make dots on the paper; a thermal head having plural heat-generating elements which are selectively energized to heat a thermally transferable ink onto the paper; and a print head of ink-jet type having plural nozzles from which ink particles gush to form characters on the paper.

In the printing apparatus constructed as previously described, the first and second printing assemblies are arranged to effect the respective type-printing and dot-matrix printing operations at spaced-apart printing positions. Therefore, it is not necessary to move the selected one of two printing assemblies to a single common printing position, or to change the printing assembly at the printing position from one to the other. Thus, the instant printing apparatus is capable of printing at high speeds in a combination mode, wherein characters are printed by type faces on the first printing assembly or with a matrix of dots created by the second printing assembly.

According to the invention, the first printing assembly for type-printing or the second printing assembly for dot-matrix printing is automatically selected by the selector means. In other words, the operator of the apparatus need not pay special attention to the selection of the two printing assemblies.

Since the number of letters and symbols used for a language is generally limited, the first printing assembly is suitably used for printing letters and symbols of a language used in a country in which the printing apparatus is used, while the second printing assembly is used for letters and symbols of foreign languages used in foreign countries. In this case, the frequently used characters are printed with higher printing quality by type elements. In addition, a daisy-type print wheel or a print ball of the first printing assembly may be formed with a comparatively reduced number of type elements, and thus manufactured at a reduced cost. Further, the time required for selecting the appropriate type element into the printing position is shortened, whereby the printing efficiency is improved.

Another advantage of the instant printing apparatus resides in its capability of preparing a document which includes graphs, maps or other graphical figures. More specifically, the graphical figures are printed with a matrix of dots by the second printing assembly, while statements are printed by the first printing assembly. Thus, the instant printing apparatus eliminates the conventional need of writing desired graphical figures on a sheet of paper in a suitable manner prior to normal printing of characters or after the normal printing.

According to one embodiment of the invention, the input printing data comprises input character data representing the characters to be printed, and the selector means has a predetermined reference and checks the input character data for each character against the reference to determine whether the character should be printed by the first printing assembly or by the second printing assembly.

In one form of the above embodiment, the selector means comprises a memory which stores a batch of converted character data corresponding to the input character data and representing the characters printable on the apparatus. The converted character data is classified into two groups having mutually distinct characteristics. One of the two groups of the converted character data represents a first group of characters which are printed by the first printing assembly, and the other group of the converted character data represents a second group of characters which are printed by the second printing assembly. Upon receiving the input character data representative of a character, the selector means reads out the corresponding converted character data from the memory and checks the characteristic thereof against the predetermined reference, thereby making a judgment whether the character represented by the input character data belongs to the first group of characters or to the second group of characters. The selector means selectively activates the first or second control means depending upon said judgment.

In accordance with a preferred arrangement of the above form of the printer, each of the converted character data consists of plural bits of data, and the selector means compares a value of at least one of the plural bits with a reference value, and thereby makes said judgment. In this case, the reference value is the predetermined reference. Preferably, each of the converted character data consists of eight bits, and a value of four successive high-order bits of the eight bits are counted from the most significant bit is compared with said reference value.

According to another embodiment of the invention, the input printing data for each character comprises character data representing the character, and print-mode designation data which indicates whether the character should be printed by the first printing assembly or by the second printing assembly. The selector means selectively activates the first or second control means according to the print-mode designation data of the input printing data.

According to an alternative embodiment of the invention, the input printing data comprises a group of character data representing a group of successive characters to be prnted, and print-mode designation data which precedes the group of character data. The print-mode designation data indicates whether the group of successive characters should be printed by the first printing assembly or by the second printing assembly. The selector means selectively activates the first or second control means according to the print-mode designation data.

BRIEF DESCRIPTION OF THE DRAWING

The above and other objects, features and advantages of the present invention will be better understood from reading the following description of the preferred embodiments taken in connection with the accompanying drawing in which.

DETAILED DESCRIPTION OF THE PREFERRED EMBODIMENTS

Referring to the accompanying drawings, preferred embodiments of the invention will be described in detail.

Figure 1:
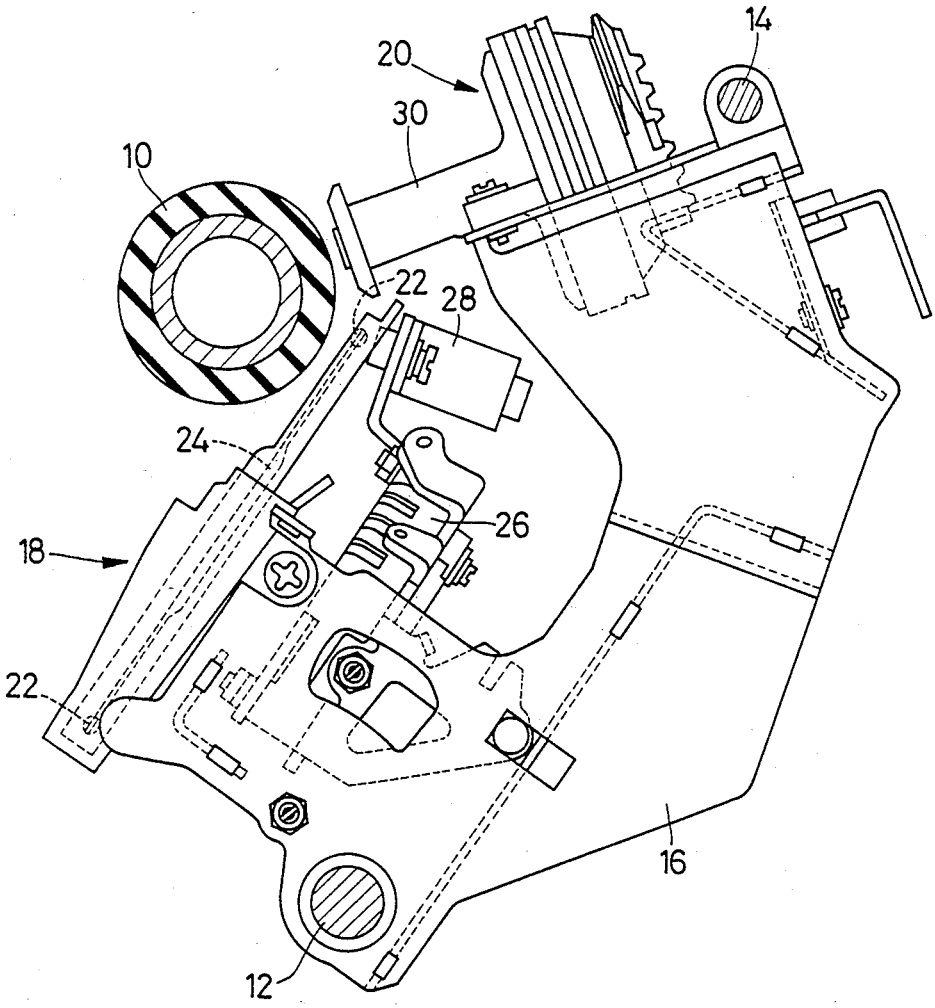
FIG. 1 is a side elevational view of printing assemblies of one embodiment of a printing apparatus of the present invention.

There is shown in FIG. 1 a printing mechanism of a printer of one embodiment of the invention, wherein reference numeral 10 designates a platen which is rotatably supported at its opposite longitudinal ends by a main frame (not shown) of the printer. The platen 10 is driven by a stepper motor, DC or AC servomotor, or any other suitable drive motor, such that the platen 10 is rotated in selected one of forward and reverse directions as required, through an angle necessary to effect a desired printing operation. The platen 10 serves as a means for supporting a sheet of paper, and cooperates with the platen drive motor to constitute paper feeding means for feeding the paper in a direction perpendicular to a line of printing. Since this paper feeding means of the printer is similar to that used in a known printer, it is not shown in FIG. 1, and generally indicated at 52, 54 in the schematic block diagram of FIG. 2, which shows a general arrangement of an electric control system of the instant printer.

The printer includes a carrier 16 supported by two guide rods 12 and 14 which extend parallel to the axis of rotation of the platen 10. The carrier 16 is slidable on the guide rods 12, 14 in selected one of opposite directions along a line of printing parallel to the platen 10, by a desired distance by means of a stepper motor, DC or AC servomotor or any other suitable drive motor. The carrier drive means is also known in the art, and therefore simply indicated at 48, 50 in FIG. 2. The carrier 16 carries a first printing assembly 18 and a second printing assembly 20, which have a first and a second print point, respectively. As described below, these first and second print points are spaced from each other circumferentially around the platen 10.

The first printing assembly 18 includes a print wheel 24 of daisy type, an indexing motor 26, and a hammer 28. The print wheel 24 has a multiplicity of radial spokes which are spaced from each other circumferentially of the wheel 24. The spokes carry at their free ends multiple type elements 22 that are abuttable against the surface of the platen 10 to print corresponding characters. The indexing motor 26 operates to rotate the print wheel 24 to bring the selected type element 22 into the first print point right above the surface of the platen 10. The hammer 28 is located behind the print wheel 18 and opposite to the first print point in order to strike the selected type element 22 at its back against the sheet of paper held on the platen 10. In the meantime, the second printing assembly 20 includes a wire-dot print head 30 having nine print wires (not shown) which are selectively pushed toward the platen 10 to form a dot-matrix pattern corresponding to a desired character, as well known in the art. The second print point of the second printing assembly 20 is spaced by one inch from the first print point of the first printing assembly 18 circumferentially around the platen 10 in the counterclockwise direction as viewed in FIG. 1, that is, in the direction in which the sheet of paper is advanced toward its leading edge.

The printing by the first printing assembly 18 is effected through a carbon ribbon of multi-strike type supplied from a movable first ribbon cassette (not shown). This ribbon cassette is supported by the carrier 16 and moved therewith along the platen 10 such that the carbon ribbon is aligned with the first print point. The printing by the second printing assembly 20 is accomplished through a fabric ribbon supplied from a stationary second ribbon cassette (not shown) which is fixed to the main frame of the printer. Since the arrangements of these first and second ribbon cassettes are not directly associated with the subject matter of the present invention, detailed description of the cassettes is not provided herein. However, their arrangements are described and illustrated in greater detail in a co-pending patent application filed Oct. 25, 1984 in the name of the present applicants, claiming the priority benefits of Japanese Patent Application Nos. 58-204357, 58-204358, 58-204359 and 58-204360.

Figure 2:
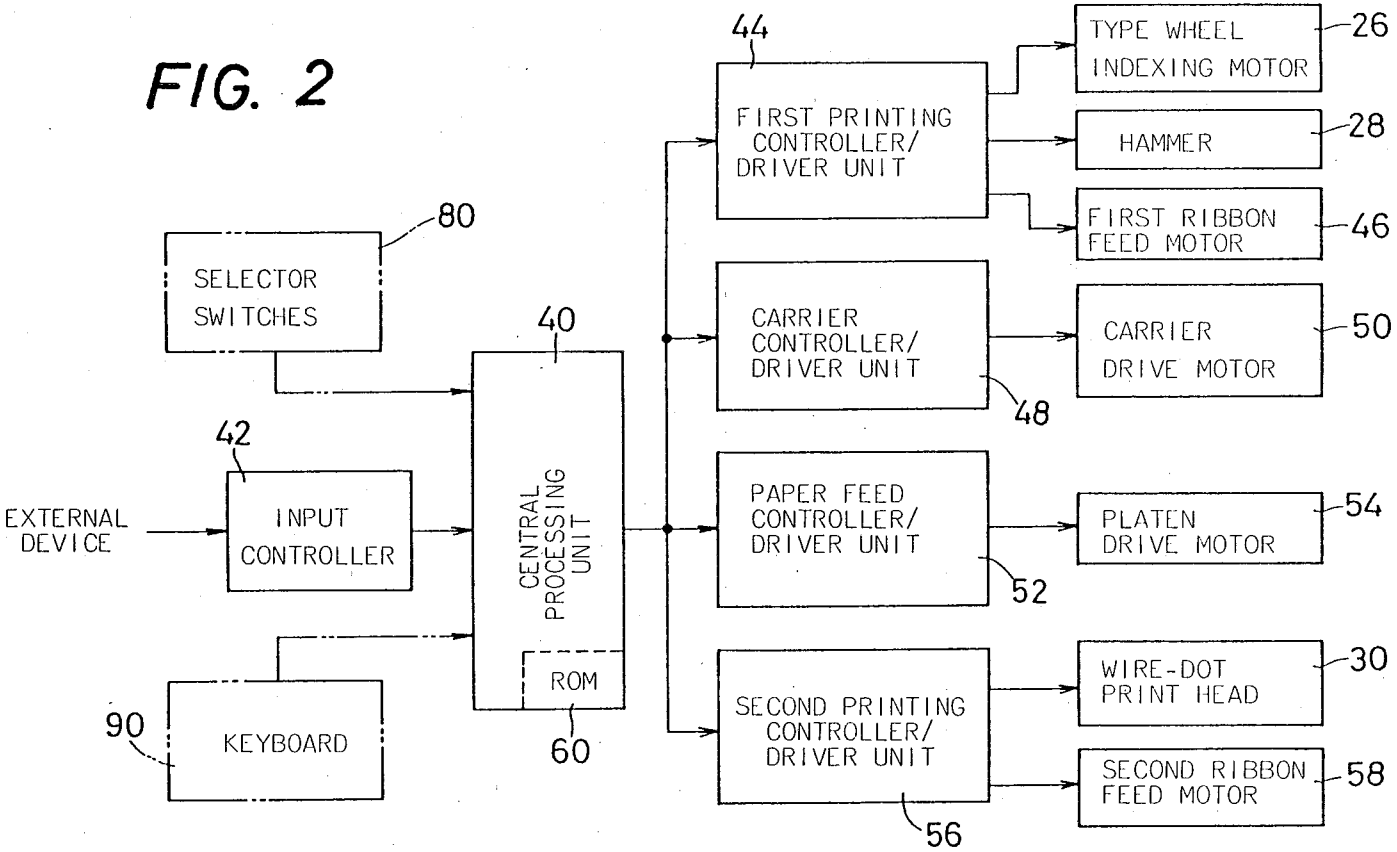
FIG. 2 is a schematic block diagram showing an electric control system of the printing apparatus of FIG. 1.

Referring next to FIG. 2, there will be described the control system of the printer whose printing mechanism is constructed as described above.

In the figure, reference numeral 40 designates a central processing unit which receives input printing data data from an external device through an input controller 42. The input printing data comprises a series of character data representing characters to be printed, format data associated with the arrangement of the characters to be printed, and other data which will be described. To the central processing unit 40 is connected a first printing controller/driver unit 44 which controls and drives the first printing assembly 18. More specifically, the first printing controller/driver 44 controls the operations of the previously indicated indexing motor 26 and hammer 28, and a first ribbon feed motor 46 for feeding the carbon ribbon for the first printing assembly 18. Further, a carrier controller/driver unti 48, a paper feed controller/driver unit 52 and a second printing controller/driver unit 56 are connected to the central processing unit 40. The carrier controller/driver unit 48 controls the operation of the carrier drive motor 50 to reciprocate the carrier 16 along the platen 10. The paper feed controller/driver unit 52 controls the operation of the platen drive motor 54 which rotates the platen 10 in its forward or reverse direction through a desired angle to feed the sheet of paper on the platen 10 in the direction normal to the line of printing, i.e., perpendicular to the axis of rotation of the platen 10. The second printing controller/driver unit 56 controls the operations of the previously described wire-dot print head 30 and a second ribbon feed motor 58 for feeding the fabric ribbon for the second printing assembly 20.

Figures 3, 5:
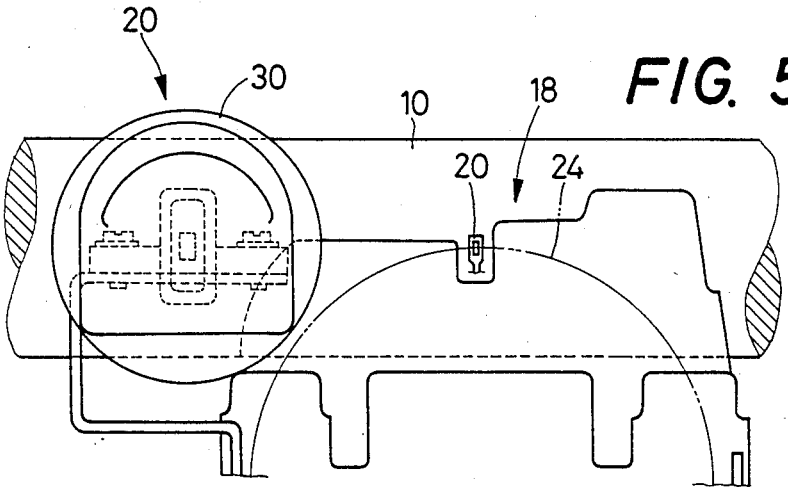
FIG. 3 is a view illustrating a table of coded data stored in a memory of the control system.
FIG. 5 is a fragmentary schematic front elevational view of the printing assemblies of another embodiment of the invention.

The central processing unit 40 has a ROM (read-only-memory) 60 which stores a batch of converted character data which correspond to input character data that represent multiple characters printable on the instant printer, such as letters, numerals, symbols and graphical figures (graphic representation elements), as illustrated in FIG. 3. Described in more detail, the ROM 60 has many memory spaces or locations each of which stores converted character data consisting of eight bits which represent each character. In this specific embodiment, these eight bits are divided into the first four high-order bits as counted from the most significant bit, and the remaining four low-order bits. Combinations of the first four bits and the remaining four bits are assigned to represent the individual characters listed in FIG. 3, wherein the values of the four bits are expressed in binary coded decimal notation. The type elements 22 provided on the print wheel 24 correspond to 96 characters which are represented by converted character data whose BCD values of the first four bits are [2] through [7] inclusive. The other characters (letters, symbols and graphic representation elements) are printed with a matrix of dots by the wire-dot print head 30. The dot-matrix pattern data representing these characters are stored in the ROM 60. Stated the other way, the batch of converted character data stored in the ROM 60 are classified into two groups, one of which represents a first group of characters which are printed by the first printing assembly 18 (with the print wheel 24), and the other group of the converted character data represents a second group of characters which are printed by the second printing assembly 20 (with the wire-dot print head 30). This classification into two groups is determined depending upon the value of the first four bits of each converted character data. That is, the character represented by input character data is printed with the print wheel 24 if the BCD value of the first four bits of the corresponding converted character data falls within the range from [2] through [7], when expressed in the binary coded decimal notation. In this embodiment, therefore, this value [7] is used as a predetermined reference with which the BCD value of each converted character data is compared when the corresponding input character data is received by the central processing unit 40. This aspect will be described in more detail.

Figure 4:
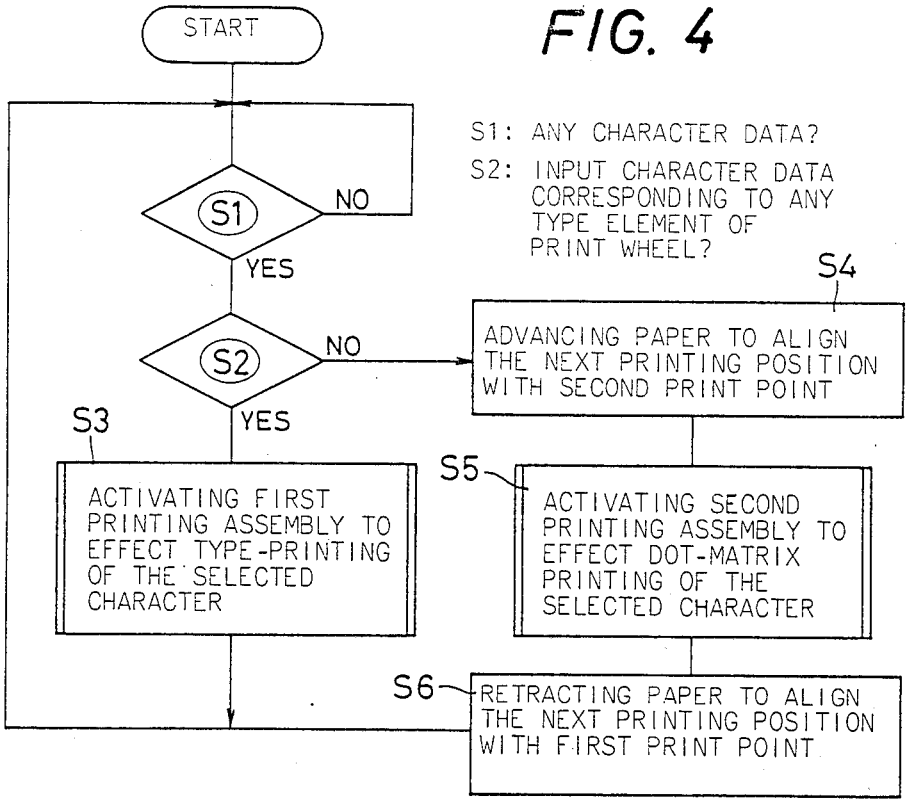
FIG. 4 is a flow chart showing a program stored in the memory of the control system.

The operation of the printer which has been described will be explained with reference to the flow chart of FIG. 4.

The central processing unit 40 repeatedly executes step S1 to check if any input character data of the printing data has been received from the external device through the input controller 42. As previously indicated, printing data comprises character data, and format data. Since the format data is not directly concerned with the subject of the invention, no further description of the format data is provided herein. When any input character data from the external device is received by the central processing unit 40 through the input controller 42, step S1 is followed step S2 to check if the received character data represents a character corresponding to any type element 22 on the print wheel 24, that is, to check if the BCD value of the first four bits of the corresponding converted character data falls within the range from [2] to [7] inclusive. Stated more particularly, the central processing unit 40 reads out from the ROM 60 the converted character data which corresponds to the input character data from the input controller 42, and compares the BCD value of the first four bits of the converted character data with the reference BCD value [7]. According to the result of this comparison, the central processing unit 40 makes a judgement whether the character designated by the input character data belongs to the first group of characters which are printed with one of the type elements 22 of the first printing assembly 18. When the received input character data corresponds to any type element 22, the affirmative judgement (YES) is obtained in step S2, and the next step S3 is executed to operate the first printing assembly 18 to print the character represented by the input character data. Thus, the central processing unit 40 activates the first printing controller/driver unit 44 to operate the first printing assembly 18. In this embodiment, the central processing unit 40 constitutes selector means for selectively activating either the first printing controller/driver unit 40 which serves as first control means, or the second printing controller/driver unit 56 which serves as second control means. In step S3, the print wheel 24 is rotated by the indexing motor 26 through an angle necessary to bring the appropriate type element 22 (corresponding to the received input character data and to the corresponding converted character data) into the printing position aligned with the previously indicated first print point defined on the platen 10. Then, the hammer 28 is energized to strike the type element 22 onto the sheet of paper through the carbon ribbon, to print the character represented by the input character data. After the printing, the first ribbon feed motor 46 is actuated to feed the carbon ribbon by a predetermined distance, and the carrier drive motor 50 is operated to move the carrier 16 to the right or left by a one-character distance. Since the program for these movements of the ribbon and the carrier is well known, further description is omitted.

Each time a character has been printed by the appropriate type element 22 as described above, the central processing unit 40 goes back to step S1 and waits for the entry of the next input character data from the external device through the input controller 42. In the case where the next input character data represents a character which does not corresponds to any of the type elements 22 of the print wheel 24, that is, if the judgement in step S2 according to the value of the first four bits of the corresponding converted character data is negative (NO), step S2 is followed by step S4 wherein the next printing position on the sheet of paper is aligned with the second print point of the second printing assembly 20. Stated more particularly, the paper feed controller/driver 52 is controlled by the central processing unit 40 so that the platen drive motor 54 is driven in the forward direction by a predetermined angle to rotate the platen 10 to advance the sheet of paper in the forward direction (toward its leading edge) by a distance of one inch. The control then goes to step S5 wherein the dot-matrix pattern data corresponding to the converted character data is read out from the ROM 60 and transferred to the second printing controller/driver unit 56 to operate the wire-dot print head 30. Simultaneously, the carrier drive motor 50 is operated, under control of the carrier controller/driver unit 48, in predetermined increments to move the print head 30, whereby a dot-matrix pattern forming the corresponding character is obtained. Thus, the character is printed with a matrix of dots. As a program for this dot-matrix printing operation is well known, no further description is provided in this respect.

After the character represented by the received input character data has been printed by the second printing assembly 20, the control goes to step S6 wherein the platen drive motor 54 is operated in the reverse direction by the paper feed controller/driver unit 52, whereby the sheet of paper is moved backward toward its trailing edge by one inch. Consequently, the next printing position on the paper sheet is again aligned with the first print point of the first printing assembly 18. After completion of this step S6, the central processing unit 40 goes back to step S1 and waits for the entry of the next input character data.

As described hitherto, the present embodiment of the printer of the invention is adapted to receive a series of input character data (and format data) from the external device to print commanded characters with the print wheel 24 if the corresponding type elements 22 are available on the wheel 24, or with the wire-dot print head 30 if the print wheel 24 does not have a type element corresponding to the commanded character. That is, the dot-matrix printing is effected automatically, depending upon the characteristic of the converted character data in the ROM 60 corresponding to the input character data, i.e., depending upon the value of the first four bits of the converted character data. While the characters are printed as the corresponding input character data are received by the central processing unit 40 in the above embodiment, it is appreciated to provide the central processing unit 40 with a buffer memory for temporarily storing a certain amount of input character data for successive characters, before the characters are printed. In this instance, a first group of characters that can be printed with the print wheel 24 is first printed by the first printing assembly 18, and a second group of characters that can not be printed with the print wheel 24 is then printed by the second printing assembly 20 after the sheet of paper is aligned with the second print point. Alternatively, it is possible that the second printing assembly 20 is operated first to print the second group characters, and the first printing assembly is then operated to print the first group of characters. It is further possible that the first and second groups of characters are printed concurrently or in a time-sharing manner by the first and second printing assemblies 18, 20.

While a dot-matrix printing operation by the second printing assembly 20 is performed in an ordinary manner, it is appreciated to move the print head 30 and/or the sheet of paper in samller steps or increments so that the adjacent dots overlap each other to improve the printing quality, that is, to reduce the difference in printing quality between the type-printing by the first printing assembly 18, and the dot-matrix printing by the second printing assembly 20.

In the illustrated embodiment, the character represented by the input character data is printed with the print wheel 24 when the corresponding type element 22 is available, and the second printing assembly 20 is automatically selected to print the character with a dot matrix when the print wheel 24 does not have a type element for the character. However, it is appreciated to provide an operator-controlled selector switch as indicated at 80 in two-dot chain line in FIG. 2, the select one of plural modes of operations, for example, a high-quality printing mode and a high-speed printing mode. In the high-quality printing mode, the characters corresponding to the type elements 22 are printed with the type elements 22 and the other characters are printed with the wire-dot print head 30 with fine feeding of the head and/or sheet of paper for overlapping dots for improved printing quality of the dot-matrix pattern. In the high-speed printing mode, all characters are printed with a dot matrix at a comparatively high speed. Thus, in this embodiment, the characters that are available on the type elements 22 can be printed with the wire-dot print head 30. That is, there are common characters which can be printed with either the appropriate type elements 22 or with the wide-dot print head 30.

Figure 6:
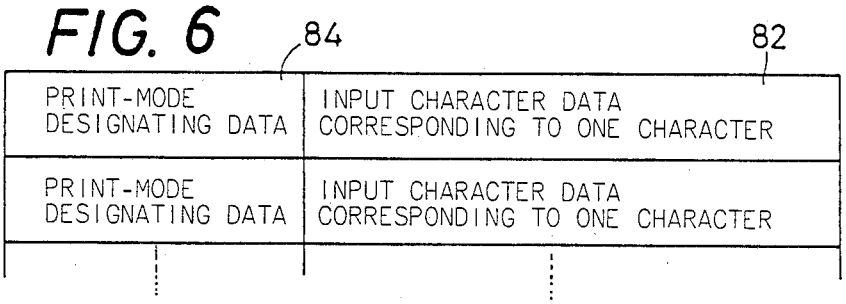
FIGS. 6 and 7 are illustrations indicating different forms of printing data received by the control system of modified embodiments of the invention.
Figure 7:
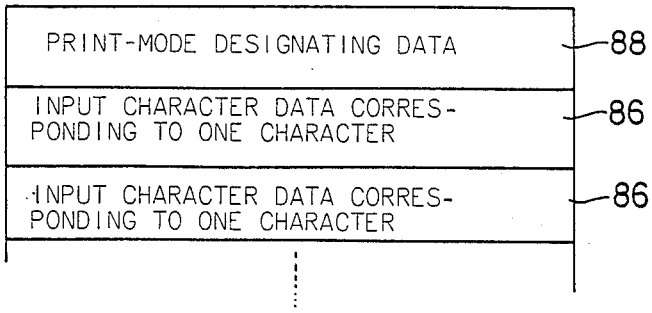

While in the illustrated embodiment the converted character data corresponding to the input character data representing each character includes the four-bit data which is checked against the reference value to select the type-printing or dot-matrix printing mode as previously discussed, it is possible that each input character data received by the central processing unit 40 is accompanied with print-mode designating data which indicates whether the character represented by the character data is printed with type elements or a matrix of dots. Examples of such print-mode designating data are shown in FIGS. 6 and 7. In the example of FIG. 6, each input character data 82 is preceded by print-mode designating data 84 which specifies the type-printing or dot-matrix printing mode. That is, the printing data for each character includes the input character data 82 and the print-mode designating data 84. In the example of FIG. 7, a group of input character data corresponding to a group of successive characters is preceded by print-mode designating data which designates either the type-printing mode or the dot-matrix printing mode.

In the illustrated embodiment, each character (letter, numeral, symbol and graphical representation element) is wholly printed with a type element or dot matrix. However, when a character consists of two or more characters (e.g., combination of a letter and a symbol) and at least one of the components of such a composite character is printable with a type element, it is appreciated that the remaining components of the composite character be printed with a dot-matrix print head. Further, the dot-matrix print head may be used to print various graphical representations. In this instance, the ROM 60 stores character data representing various graphical representation elements which are combined to form a desired graphical figure such as a graph. Further, it is possible to print a desired graphical figure with a dot matrix according to dot-matrix pattern data transferred from an external device.

While the above-indicated modifications are all concerned with the programs stored in the central processing unit 40, and possible by changing such programs, various modifications and changes of the mechanical arrangements of the printer are also possible within the scope of the invention.

For example, the first and second printing assemblies 18, 20, which are disposed in spaced-apart relation circumferentially around the platen 10 (in the direction of paper feed) in the illustrated embodiment, may be disposed so that their first and second print points are spaced from each other in the direction parallel to the line of printing, i.e., along the axis of the platen 10, as shown in FIG. 5. In this modified arrangement, the first and second printing assemblies have their print points on the same line. Consequently, it is not required to feed the sheet of paper back and forth to align the currently printed line with the print point of the newly selected printing assembly. It will be obvious to dispose the first and second printing assemblies so that their print points are spaced from each other in both circumferential and axial directions of the platen 10.

Although in the illustrated embodiment the first ribbon cassette for the first printing assembly 18 is movable with the carrier 16 while the second ribbon cassette for the second printing assembly 20 is stationary, it is possible that the first ribbon cassete be stationary while the second ribbon cassette be movable, or both ribbon cassettes be movable with the carrier 16. It is further possible to use a common ribbon cassette for the first and second printing assemblies. Further, the present invention may be embodied as a printer of the type which does not use a ribbon but uses heat-sensitive paper.

As a further modification, it is possible that the printer be equipped with a keyboard 90 as indicated in two-dot chain line in FIG. 2, in addition to, or in place of, the input controller 42.

It will be obvious that other changes, modifications and improvements may occur to those skilled in the art without departing from the scope of the invention defined in the appended claims.

What is claimed is:

1. A printing apparatus having a platen to support a sheet of paper and a carrier which reciprocates to print a succession of characters along a line of printing defined on the platen, according to input printing data, said printing apparatus comprising:

paper feeding means for feeding the sheet of paper on said platen in a direction perpendicular to said line of printing;

a first printing assembly supported on said carrier and having type elements adapted to be abuttable on said platen for printing a first group of characters on the sheet of paper along the line of printing, said first printing assembly having a first print point at which the first group of characters are printed by said type elements;

a second printing assembly supported on said carrier for printing a second group of characters on the sheet of paper with a matrix of dots, said second printing assembly having a second print point at which the second group of characters are printed with the matrix of dots, said second print point being spaced from said first print point in a direction along the surface of said platen, said first and second groups of characters including common characters which can be printed by both of said first and second printing assemblies;

first and second control means for controlling the printing operations of said first and second printing assemblies, respectively; and selector means for receiving said input printing data and for selectively activating said first control means or said second control means to control the operation of said first or second printing assembly, said selector means comprising:

a memory which stores a first and a second group of converted character data corresponding to input character data of said input printing data and which represent said first and second groups of characters;

means for receiving the input character data and reading the corresponding converted character data;

means for determining whether said corresponding converted character data belongs to said first group of converted character data; and means for activating said first control means when said corresponding converted character data belongs to said first group of converted character data, and activating said second control means when said corresponding converted character data does not belong to said first group of converted character data.

2. The printing apparatus of claim 1, wherein said second print point is spaced from said first print point in a direction perpendicular to said line of printing.

3. The printing apparatus of claim 1, wherein said second print point is spaced from said first print point in a direction parallel to said line of printing.

4. The printing apparatus of claim 1, further comprising a keyboard as input means which generates said input printing data, and keyboard cooperating with the printing apparatus to constitute a typewriter.

5. The printing apparatus of claim 1, wherein said platen is rotatable about its axis, and constitutes a part of said paper feeding means.

6. The printing apparatus of claim 1, wherein said first printing assembly comprises a daisy-type print wheel having said type elements, a hammer located on an opposite side of said print wheel from said platen, and means for energizing said hammer to strike one of said type elements which is located in alignment with said first print point.

7. The printing apparatus of claim 1, wherein said second printing assembly comprises a wire-dot print head having a plurality of wires.

8. The printing apparatus of claim 1, further comprising:

means for determining whether said corresponding converted character data belongs to said second group of characters; and an operator-controlled selector switch for selecting between:

a first mode in which said selector means activates said first control means when said corresponding converted character data belongs to said first group of converted character data, and activates said second control means when said corresponding converted character data does not belong to said first group of converted character data; and a second mode in which said selector means activates said second control means when said corresponding converted character data belongs to said second group of converted character data.

9. The printing apparatus of claim 1, wherein said second group of characters further comprises at least one mixed print character having a first part which can be printed by said first printing assembly and a second part which can be printed by said second printing assembly, and wherein said selector means further comprises:

means for determining whether said converted character data corresponds to a mixed print character; and means for activating said first and second control means when said converted character data corresponds to a mixed print character to print said first part of said character using said first printing assembly and said second part of said character using said second printing assembly.

* * * * *